US008776949B2

(12) United States Patent
Oswalt

(10) Patent No.: US 8,776,949 B2
(45) Date of Patent: Jul. 15, 2014

(54) SYSTEMS AND METHODS FOR COVERING LADDER RUNG THROUGHBORES

(76) Inventor: Kevin D. Oswalt, North Prairie, WI (US)

( * ) Notice: Subject to any disclaimer, the term of this patent is extended or adjusted under 35 U.S.C. 154(b) by 167 days.

(21) Appl. No.: 13/557,665

(22) Filed: Jul. 25, 2012

(65) Prior Publication Data

US 2014/0026383 A1 Jan. 30, 2014

(51) Int. Cl.
*E06C 7/00* (2006.01)

(52) U.S. Cl.
CPC ..... *E06C 7/00* (2013.01)
USPC ..... 182/129; 182/151; 182/230

(58) Field of Classification Search
USPC ..... 40/309, 311, 315; 182/129, 151, 229, 182/230
See application file for complete search history.

(56) References Cited

U.S. PATENT DOCUMENTS

| | | | | | |
|---|---|---|---|---|---|
| 685,561 | A | | 10/1901 | Bettermann | |
| 1,205,891 | A | | 11/1916 | Harrison | |
| 2,081,675 | A | * | 5/1937 | Muldoon | 337/261 |
| 2,537,184 | A | * | 1/1951 | Dunn | 206/226 |
| 3,119,435 | A | * | 1/1964 | Greenman | 29/243.517 |
| 3,354,987 | A | * | 11/1967 | Werner et al. | 182/228.4 |
| 3,358,869 | A | | 12/1967 | Palmer et al. | |
| 3,821,969 | A | | 7/1974 | Sinko | |
| 4,615,460 | A | | 10/1986 | Buccellato et al. | |
| 4,640,434 | A | | 2/1987 | Johnsen et al. | |
| 4,745,696 | A | * | 5/1988 | Scouten | 40/309 |
| 4,815,783 | A | | 3/1989 | Montreuil et al. | |
| 4,844,285 | A | | 7/1989 | Horiki et al. | |
| 4,964,438 | A | | 10/1990 | Welty | |
| 4,972,571 | A | | 11/1990 | Cole et al. | |
| 5,010,667 | A | * | 4/1991 | Hassinger | 40/309 |
| 5,016,674 | A | | 5/1991 | Kiss | |
| D359,294 | S | * | 6/1995 | Szabo | D15/199 |
| 5,803,126 | A | | 9/1998 | Zaro | |
| D421,792 | S | | 3/2000 | Bevacco | |
| 6,032,695 | A | | 3/2000 | Wellen et al. | |
| 6,113,327 | A | * | 9/2000 | Schrader | 410/97 |
| 6,161,507 | A | | 12/2000 | French, Jr. | |
| 6,280,128 | B1 | * | 8/2001 | Schrader | 410/97 |
| 6,494,463 | B1 | | 12/2002 | Rank | |
| 6,994,326 | B1 | | 2/2006 | Tyson | |
| 7,490,629 | B2 | | 2/2009 | Williams et al. | |
| 8,052,003 | B2 | * | 11/2011 | Burns | 220/254.7 |
| 2002/0043036 | A1 | * | 4/2002 | Nesbitt | 52/301 |
| 2004/0084099 | A1 | | 5/2004 | Mirua | |
| 2008/0141574 | A1 | * | 6/2008 | Jones | 40/660 |
| 2008/0209829 | A1 | * | 9/2008 | Lucas | 52/302.7 |

* cited by examiner

*Primary Examiner* — Alvin Chin-Shue
*Assistant Examiner* — Colleen M Chavchavadze
(74) *Attorney, Agent, or Firm* — Ryan Kromholz & Manion, S.C.

(57) ABSTRACT

Provided is a plugging device for covering the open ends of the rungs of a ladder. The device includes a pair of plug members and a connection member. The plug members include a plug body to cover the open ends of the rung and sit adjacent to the ladder rail and a gasket configured for insertion into the ladder rung. The gasket is made of a flexible, compressible material to fit snugly within the open end of the ladder rung. The connection member is configured to be passed through the ladder rung and is elastically biased to pull the pair of plug members towards one another, when connected, through the ladder rung and secure them in place in the open ends.

23 Claims, 3 Drawing Sheets

SYSTEMS AND METHODS FOR COVERING LADDER RUNG THROUGHBORES

BACKGROUND OF THE INVENTION

The present invention relates to terminal end plugs for tubular members. In particular, this invention relates to a device and method for covering the terminal, open ends of a ladder rung. Generally, various service vehicles, especially service vans, must carry ladders to worksites. These ladders may be step ladders or extension ladders. While some ladders have platform, open-channel steps, many ladders, especially extension ladders, employ hollow rungs that extend between the ladder rails. The ends of these hollow rungs are generally not capped. Ladders are normally carried in an uncovered state on the roof of such service vehicles, where the ladders are usually oriented such that the rungs lie in a transverse, or perpendicular, nature to the direction of travel of the vehicle. Consequently, the ambient air, as the vehicle is moving forward, passes over the open ends of the ladder rungs. As the air passes over the open ends of the ladder rungs, the open ends act as a pair of embouchures, causing substantial acoustic vibration and noise. The noise is especially noticeable in vans that do not have insulation on the inside of the roof panel, which is usually the case with service vans.

Accordingly, there is a need for a system and a method to cover the open ends of the ladder rung for the purpose of substantially quieting the noise produced when air travels across these open ends as the carrying vehicle is in motion, and for otherwise protecting the open channels.

SUMMARY OF THE INVENTION

The present invention provides such a system and method for substantially quieting the noise produced by the open ends of the ladder rung while in motion. One embodiment according to the present invention includes a pair of plug members that interface to the open ends of a ladder rung throughbore. The plug members include a plug body and a flexible gasket. The plug body may be a convex disk, formed of a hard plastic material. The plastic material of the plug body may have an opening in which to insert a design or logo, serving an aesthetic purpose, or other purposes such as advertisement.

Attached to the inner surface of the plug body is the gasket. The gasket may be formed of a soft, flexible material, such as water-resistant foam. The flexible foam gasket is preferred such that it may be inserted and fit snugly into rung openings of various shapes and sizes.

Also found on the inner surface of the plug body is an anchor attachment point. The anchor attachment point may attach and anchor, having on its distal end an attachment mechanism, such as a loop to which a corresponding hook on a connection member may be attached. The connection member draws the pair of plugs toward each other within the ladder rung. In a preferred embodiment the connection member is a bungee cord. The connection member may be drawn through the ladder rung by passing a threading mechanism through the rung, attaching it to the free end of the connection member, and pulling the free end back through the rung to attach to the attachment mechanism on the other plug member.

At least one end of the connection member must be releasably attached to the corresponding plug body, in order that the cord may be threaded through the ladder rung to connect to the second plug body on the opposing end. In one embodiment, both ends of the connecting member are releasably attached to the plug body by hook and loop configuration.

While a single plug may be provided as a stand-alone unit, it is preferred to provide at least two plugs and a connection member in a kit form. Furthermore, it is preferred that a plurality of pairs of plugs be provided in a kit form. Such kits may be provided in, for example, 16-rung kits, 20-rung kits, 24-rung kits, 28-rung kits, etc., which may correspond to the length of the ladder on which the plugs will be used. In a 16-rung kit, at least 32 plugs may be provided, and at least 16 connection members may be provided. Extra units may be provided to accommodate specific ladder types. The kit may further include the threading mechanism to draw the end of the elastic biasing member through the ladder rung and labels to be inserted into the plug body, viewable on the side of the ladder.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
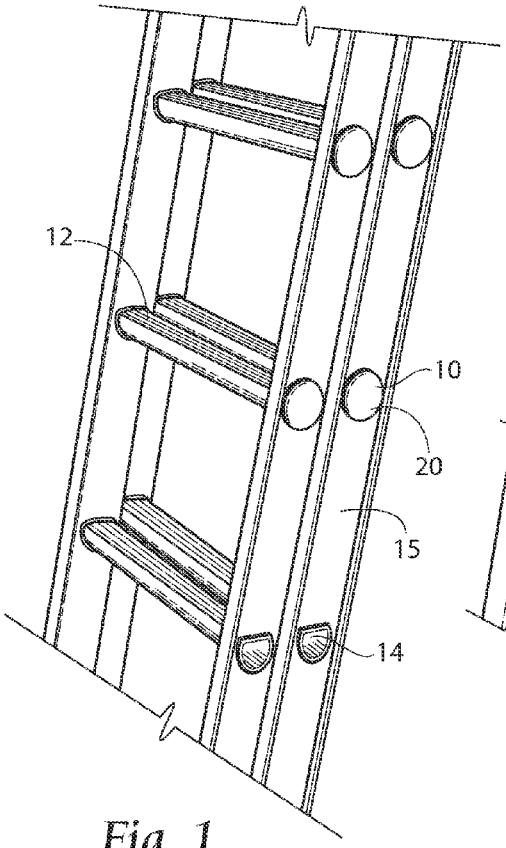
FIG. 1 is a perspective view of a ladder with an embodiment of a plugging device according the present invention.

FIG. 1 shows a typical utility ladder having a hollow rung 12 and the rung 12 having a pair of open ends 14. FIG. 1 also shows some of the hollow rungs 12 having a plugging device 10 according to the present invention covering open ends 14.

Figure 2:
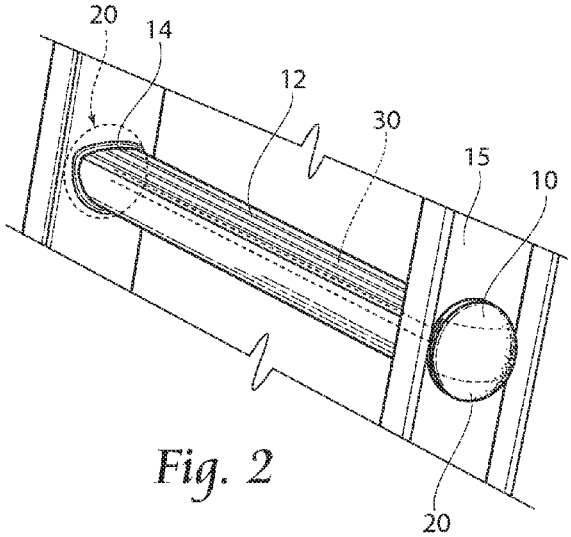
FIG. 2 is a perspective view of a single ladder rung from FIG. 1 with the embodiment of a plugging device according to the present invention.

FIG. 2 shows a plugging device 10 having a pair of plug members 20, coupled together by a connection member 30, being used to plug the open ends 14 of the ladder rung 12.

Figure 3:
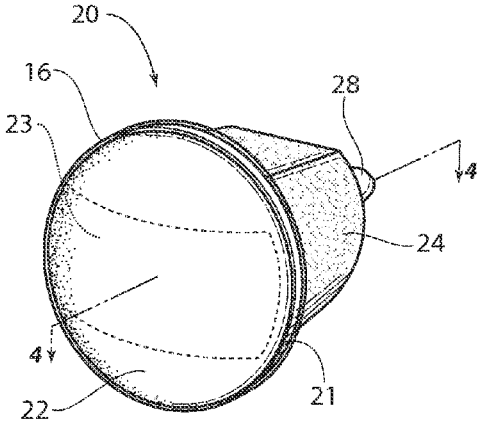
FIG. 3 is a perspective view of a plug body according to the present invention.
Figure 4:
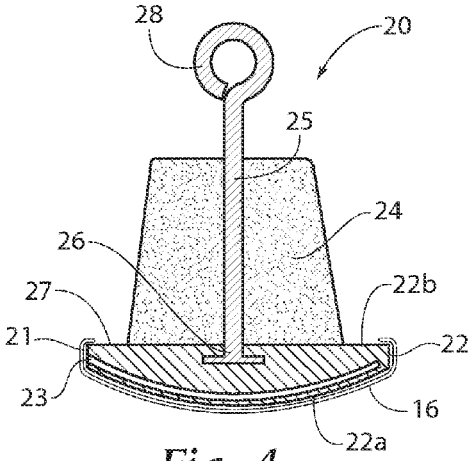
FIG. 4 is a cross-sectional view of the plug body of FIG. 3.
Figure 7:
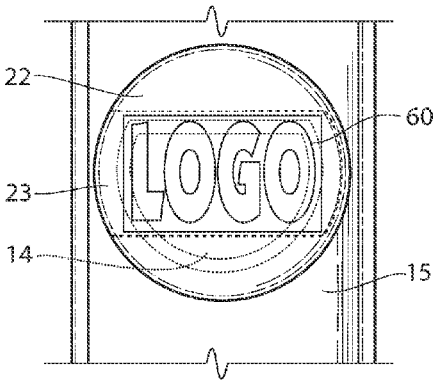
FIG. 7 is a side elevation view of the ladder rung open end of FIG. 6 covered by a plugging device according to the present invention.
Figure 8:
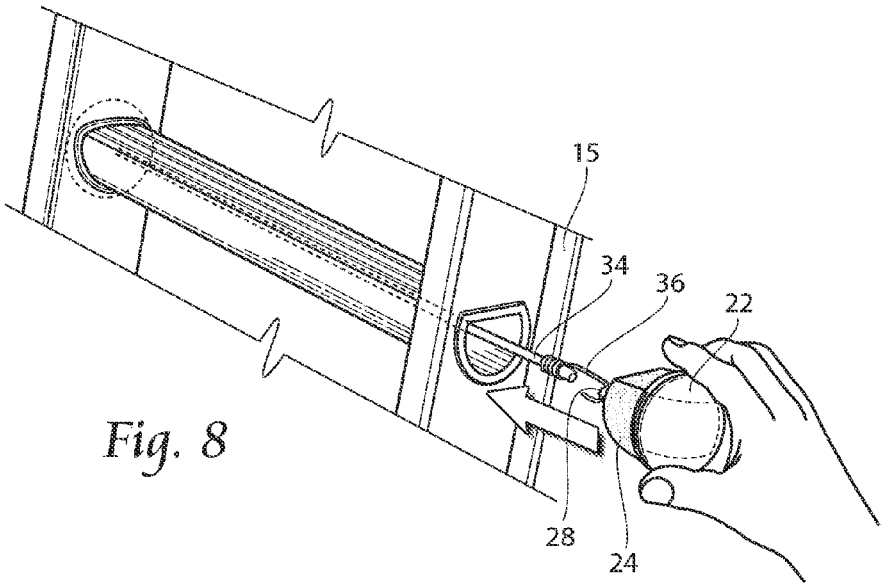
FIG. 8 is a perspective view of a plugging device according to the present invention being placed in an open end of a ladder rung.

FIG. 3 shows a plug member 20 according to the present invention. The plug member 20 has a plug body 22 and a gasket 24. The plug body 22 is preferably formed of a molded thermoplastic material, but may otherwise be any material suitable for covering the open ends 14 of the ladder rung 12, and strong enough to maintain its shape when the force of the connection member 30 is applied. In the preferred embodiment, the plug body 22, or at least the outer portion thereof, is generally convex. The convex nature of the plug body 22 allows for reduced air resistance and aids in reducing wind noise. The plug body 22 may be disc-like in shape, but it may also be a square, rectangle, or any other shape that is desired by the manufacturer or user. The plug body 22 is configured to be positioned adjacent to the outer rail 15 of the ladder, as shown in FIGS. 1 and 2. The plug body 22 is preferably sized and configured to at least substantially (>50%), but preferably completely cover the rung opening 14 (illustrated in FIG. 7). The plug body 22 forms an outer edge 21. As shown in FIG. 4, the plug body 22 may be configured in layers 22*a*, 22*b* with an opening 23 in which to slide a label 60 or other decorative object, which provides an aesthetically pleasing and uniform look, as well as provides advertisement opportunities or serves other purposes. The opening 23 may extend through the body 22 from one portion of the outer edge 21 to an opposing side of the outer edge 21, with closed areas therebetween. Alternatively, up to half of the outer edge may provide access to opening 23 with the other at least half of outer edge 21 having layers 22*a*, 22*b* connected and closed. FIGS. 2-4 show this preferred embodiment where only a portion of outer edge 21 provides access to opening 23. The opening 23 is at least large enough to accommodate sliding a label 60 or other decorative object within the opening. The body 22 may or may not have the opening 23, and the opening 23 may or may not contain a label 60 or other decorative object.

Figure 5A:
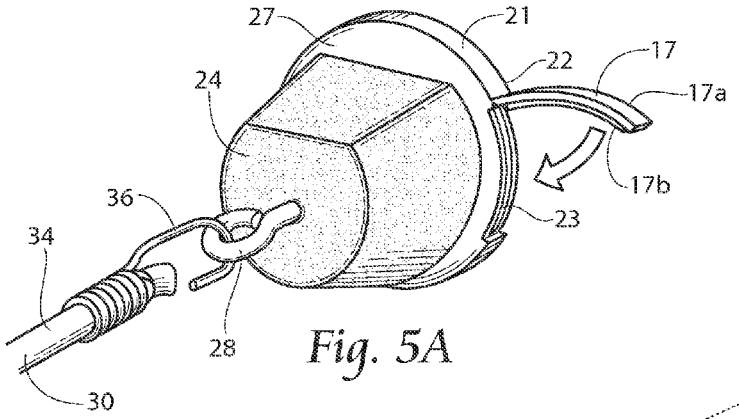
FIG. 5A is a perspective view of the plug body of FIG. 3 in cooperation with a connection member according to the present invention.
Figure 5B:
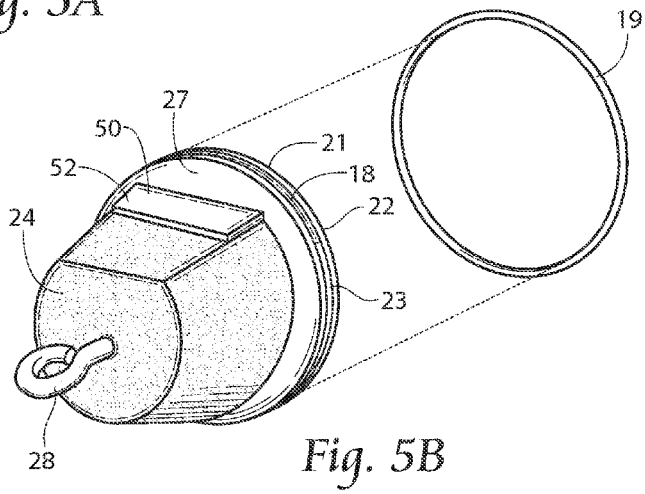
FIG. 5B is a perspective view of an alternative embodiment of a plug body according to the present invention.
Figure 6:
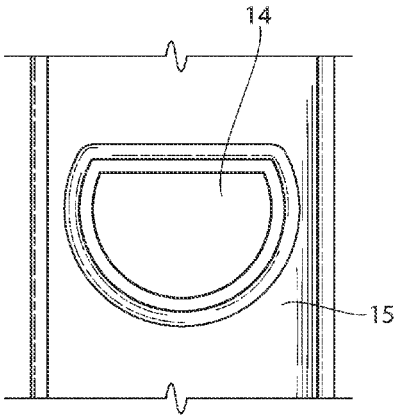
FIG. 6 is a side elevation view of a ladder rung open end.

The opening 23 may be sealed in a water-tight fashion in order to prevent the access of moisture, such as rain or other precipitation, or moisture in the air from entering the opening 23. Such water-tight sealing may be provided by a plug body case 16 that covers the outer layer 22*a*, the outer edge 21, and at least a portion of the bottom layer 22*b*, as shown in FIG. 4. The plug body case 16 may be constructed of a flexible, elastic material such as silicone rubber. The opening 23 may also be sealed via a cover tab 17 that is hingedly connected to the plug body 22, such as to the outer edge 21 as shown in FIG. 5A. The cover tab 17 preferably comprises a cover portion 17*a* and an insertion portion 17*b*, such that that cover portion 17*a* covers the opening 23 and at least a portion of the surrounding area, and the insertion portion 17*a* can be partially inserted into the opening 23. The cover tab 17 is preferably made of a flexible material, such as silicone, but may also be constructed of a hard plastic material. The water-tight sealing may also be provided by an o-ring configuration, as shown in FIG. 5B. In this embodiment, the plug body 23 may have a groove 18 formed in the outer edge 21 about the circumference of the plug body 23. The groove 18 is configured to receive an o-ring 19, or rubber band type device, to at least partially extend about the perimeter of the outer edge 21 and cover the opening 23. In addition to these embodiments of water-tight sealing, other means may be used to close off the opening 23 and prevent moisture from entering.

In an alternative embodiment, the plug body 22 may have a logo or other decorative element printed or stamped directly on or formed in the thermoplastic material of the outer layer 22*a* of the plug body 22, or it may be printed or stamped on a sticker or a plug body cover, such as the flexible plug body cover 16 discussed above, which covers the outer layer 22*a* of the plug body 22 to provide the aesthetic or advertisement feature of the plug body 22.

The gasket 24 of the plug member 20 is affixed to the inner surface 27 of the plug body 22. The gasket 24 is configured to fit into the opening 14 of the ladder rung 12. The gasket 24 is preferably formed of a soft, flexible material so it may be fit into rungs 12 of various shapes and sizes. The material is preferably water resistant to maintain the integrity of the gasket 24 in all weather conditions. The gasket 24 is preferably sized and configured for the broadest portion of the gasket 24 to be substantially the same shape and dimension as the ladder rung opening 14, or slightly larger than the opening 14 such that a tight fit is created when the flexible gasket material is inserted and compressed within the ladder rung opening 14. The gasket 24 may also be frustoconical in shape, with the broadest portion of the gasket 24 being situated adjacent to the inner surface 27 of the plug body 22 and the narrowest portion disposed at a distal end opposite of the broad portion. This accommodates insertion into the ladder rung, allowing for the narrow side to be inserted easily into the open end 14 and becoming increasingly tight as the gasket 24 is inserted fully into the open end 14, creating a secure fit.

As shown in FIG. 4, there may be an anchor attachment point 26 generally centrally located on the plug body 22. An anchor 25 may extend from the anchor attachment point 26 to a distal end. Between the attachment point 26 and the distal end, the anchor 25 is at least partially surrounded by the flexible gasket 24. The distal end of the anchor 25 may contain an attachment mechanism 28. In a preferred embodiment, the attachment mechanism 28 is a loop or hook, but may be any attachment device to which a counterpart end 36, such as a hook, of the connection member 30 can releasably attach. Alternatively, in the plugging device 10 having a pair of plug members 20, the attachment mechanism 28 on one of the pair of plug members 20 may be substantially permanently attached to a counterpart end 36 on the connection member 30 while the other plug member 20 provides an attachment mechanism 28 that is releasably attachable to the connection member 30.

The connection member 30 preferably comprises an elastic biasing means. In the embodiments shown, the connection member 30 is a bungee cord 34 with the elastic biasing means being provided by the elastic nature of the bungee cord. The elastic biasing means may also be an elastic mechanism, such as a spring (not shown), that connects a non-elastic cord (not shown) to the attachment mechanism 28. In another alternative, the anchor 25 may be attached to the plug body 22 in a biased relationship, such as via a spring, to provide the biased force when two plug members 20 are connected via the connection member 30. As shown, the connection member 30 is preferably threaded through the ladder rung 12 and utilizes the elastic bias to draw the pair of plug members 20 towards each other and hold the plug members 20 securely in the ladder rung openings 14.

The connection member 30, including the elastic biasing means, may be tailored to correlate to the length of the ladder rung 12 such that the force created by the biasing connection member can maintain the pair of plug members 20 in the ladder rungs 12, but not so great so as to prevent connection of the two plug members 20 to one another.

It may be advantageous for there to be uniformity in plug orientation, when multiple plugging devices 10 are used. For this, and any other reason that rotation of plug member 20 is undesirable, the plug member 20 may further include a rotation prevention member 50, as shown in FIG. 5B. This may be particularly useful when the ladder has D-shaped rungs. The rotation prevention member 50, such as a longitudinal rib member 52, is affixed to the inner surface 27 of the plug body 22 and is configured to be positioned in relative position to a flat surface of the D-shaped rung. When inserted into the ladder rung 12, the rib member 52 may prevent the plug member 20 from turning while the gasket portion 24 is inserted into the rung 12. Additionally or alternatively, the gasket 24, itself, may serve as an anti-rotation member by imparting a sufficient friction force against the open end 14 of the rung 12 so as to prevent rotation by normal use or even wind during ladder transport.

Figure 9:
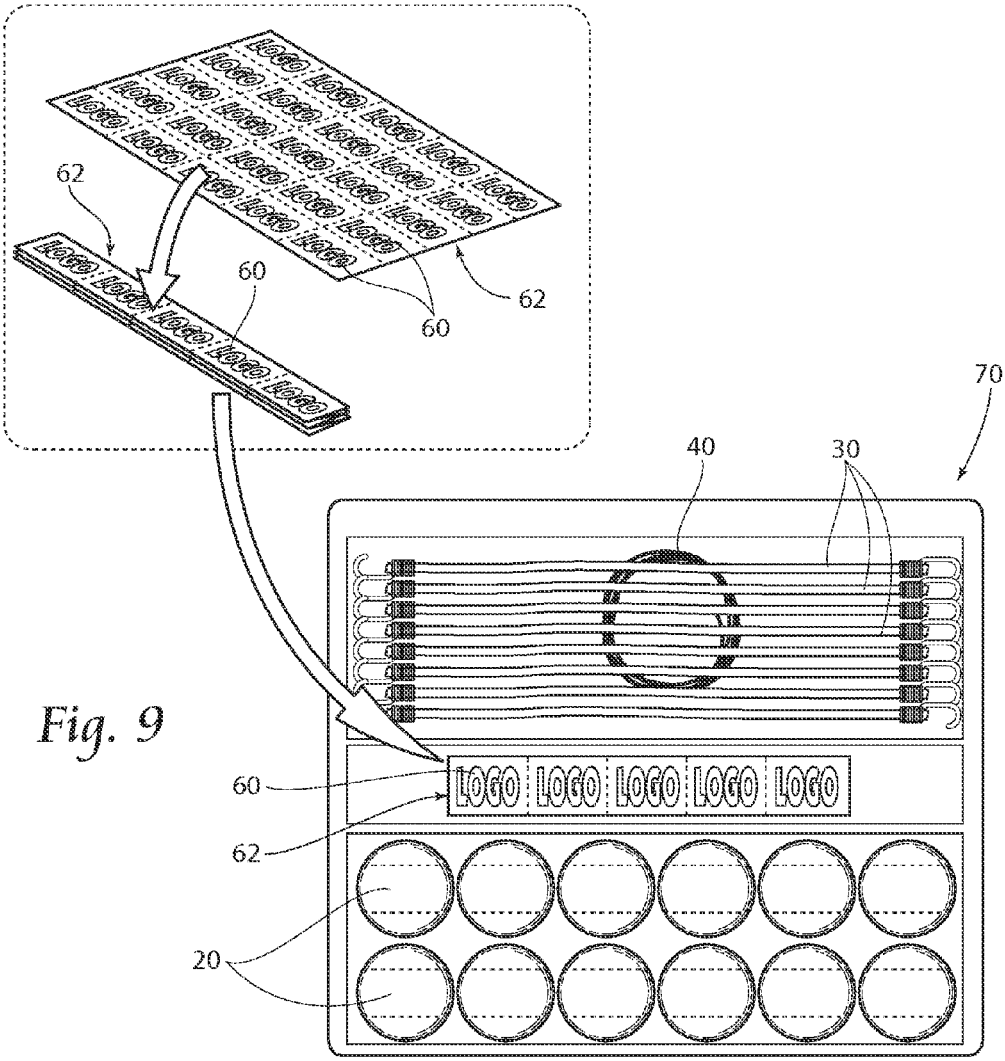
FIG. 9 shows an embodiment of a kit according to the present invention.

An embodiment of the present invention may also be provided as a kit 70, such as the kit shown in FIG. 9. Each kit 70 may include a plurality of plugging devices 10. The kit 70 may include a predetermined number of plugging devices 10 made up of pair of plug members 20, and connection mechanisms 30, corresponding to the size of the ladder. For example, the device may be provided in 16-rung, 20-rung, 24-rung, 28-rung kits, corresponding to common ladder sizes, or may be provided with any number of plugging devices 10, with additional, individual plugging devices 10 being available to accommodate other ladder sizes. As an example, a 16-rung kit may include 32 plug members 20, 16 connecting mechanisms 30, a threading device 40 to thread the connection member 30 through the rung 12, and a page 62 of labels 60 that are either pre-printed or may be printed on by the user to be inserted into or applied to the plug body 22, if desired. Additional, individual components may be provided separately for when an extra is desired or an element has been lost, damaged, or is otherwise unavailable.

Also according to the present invention, a method of using a plugging device 10 wherein at least one plugging device 10 is provided, the connection member 30, such as a bungee cord 34, may be positioned through the ladder rung 12, and the plug members 20 are placed in and over the ladder open ends 14. A threading device 40, such as a coiled wire may be provided that may be inserted through the ladder rung 12. The threading device 40 may be greater in length than the ladder rung 12, such that at least a portion thereof extends on each side of the ladder rung 12 when threaded therethrough. Once threaded through the ladder rung 12, the threading device 40 may be attached to an attachment end 36 on connection member 30. The connection member 30, by way of threading device 40 may then be pulled back through the ladder rung 12 thereby exposing the attachment ends 36 of the elastic mechanism 30 on the opposing open ends 14 of the ladder rung 12. The elastic mechanism 30 may then attach to the attachment mechanism 28 on each of the plug members 20. When the connection member 30 is attached, each of the plug member gaskets 24 may be inserted into the open end 14 of the ladder rung. The elastic or other biasing means in the connection member 30 keeps the plug body 20 over the open ends 14 of the ladder rung 12. Additionally or alternatively, each connection member 30 may be sized and configured so as to pass through a rung 12 with little friction, which may eliminate any need or desirability of such threading device 40.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

I claim:

1. A device for plugging open ends of a ladder rung on a ladder, said device comprising:

a pair of plug members sized and configured to interface with the open ends of said ladder rung; and an elastically biased connection member coupling said pair of plug members;

wherein each of said pair of plug members comprises a plug body and a gasket, said gasket having a proximal end and a distal end, said proximal end being positioned on at least a portion of an inner surface of said plug body;

said plug body configured to substantially cover the open end of said ladder rung and be positioned substantially perpendicular to said ladder rung, adjacent to a rail of said ladder; and said gasket portion configured to be at least partially inserted into said open end of said ladder rung.

2. The device of claim 1 wherein said plug body of at least one of said plug members comprises an outer face, said outer face being generally convex.

3. The device of claim 1 wherein said plug body of at least one of said plug members is generally disc-shaped.

4. The device of claim 1 wherein said plug body of at least one of said plug members comprises a molded thermoplastic material.

5. The device of claim 1 wherein said gasket of at least one of said plug members comprises a compressible material.

6. The device of claim 5 wherein said compressible, flexible material is a water-resistant foam material.

7. The device of claim 1 wherein said gasket of at least one of said plug members is configured in the same shape as said open end of said ladder rung.

8. The device of claim 1 wherein said gasket of at least one of said plug members is frustoconical in shape, with the broadest portion of said gasket situated adjacent to said inner surface of said plug body.

9. The device of claim 1 wherein at least one of said plug members further comprises an attachment mechanism extending at least partially beyond said distal end of said gasket, said attachment mechanism being configured for releasable attachment to an end of said connection member.

10. The device of claim 9 wherein said attachment mechanism comprises a loop.

11. The device of claim 1 wherein at least one of said plug members further comprises a rotation prevention member positioned on said inner surface of said plug body.

12. The device of claim 11 wherein said rotation prevention member is a longitudinal rib member configured to be positioned relative to a counterpart portion of said open end of said ladder rung.

13. The device of claim 1 wherein at least one of said plug members further comprises an outer edge having at least one opening for accessing a cavity for receiving a decorative element.

14. The device of claim 13 further comprising sealing means to provide water-tight sealing of said at least one opening.

15. The device of claim 1 wherein said plug body has a decorative element printed or stamped on an outer face of said plug body.

16. The device of claim 1 further comprising a decorative element the covers an outer face of said plug body.

17. The device of claim 1 wherein said elastically biased connection member is configured such that the force applied to said pair of plug members by said connection member is sufficient to hold said plug members in place but not so great so as to impede connection of said plug members through the ladder rung.

18. The device of claim 1 wherein said connection member comprises a bungee cord.

19. A kit for plugging open ends of ladder rungs of a ladder, comprising:

a predetermined number of plug members; and a predetermined number of connection members, each connection member configured for biasing two of said plug members towards each other within one of said ladder rungs, wherein said predetermined number of connection members is at least as great as the number of ladder rungs in said ladder that are desired to be covered by said plug members.

20. The kit of claim 19 further comprising a predetermined number of decorative elements to be inserted into said plug member.

21. The kit of claim 20 wherein said number of decorative elements is at least as great as the predetermined number of plug members provided.

22. The kit of claim 19 wherein said predetermined number of plugging devices comprises one of the following: 16 pairs, 20 pairs, 24 pairs, and 28 pairs, to correlate with the number of rungs provided in a standard sized ladder.

23. The kit of claim 19 further comprising at least one, threading mechanism configured for pulling said connection members through said ladder rungs.

* * * * *